US005678584A

United States Patent [19]

O'Brien

[11] Patent Number: 5,678,584

[45] Date of Patent: Oct. 21, 1997

[54] TUBE CLEANING APPARATUS

[75] Inventor: Dudley L. O'Brien, Los Angeles, Calif.

[73] Assignee: McDonnell Douglas Corporation, Huntington Beach, Calif.

[21] Appl. No.: 509,547

[22] Filed: Aug. 31, 1995

[51] Int. Cl.[6] ..... B08B 9/02

[52] U.S. Cl. ..... 134/166 R; 138/45; 277/34

[58] Field of Search ..... 134/166 R, 166 C, 134/169 R, 169 C, 170; 251/5; 15/304; 138/45; 277/34, 36

[56] References Cited

U.S. PATENT DOCUMENTS

| | | | |
|---|---|---|---|
| 2,026,916 | 1/1936 | Smith | 251/5 X |
| 2,066,544 | 1/1937 | Shaw | 138/45 X |
| 2,071,197 | 2/1937 | Burns et al. | 277/34 |
| 2,193,587 | 3/1940 | Fortune et al. | 277/34 |
| 2,518,625 | 8/1950 | Langstaff | 251/5 X |
| 4,412,554 | 11/1983 | Chow | 251/5 X |
| 5,188,134 | 2/1993 | Satoh et al. | 251/5 X |
| 5,372,154 | 12/1994 | Bee et al. | 134/167 C X |

FOREIGN PATENT DOCUMENTS

| | | | |
|---|---|---|---|
| 3102363 | 8/1982 | Germany | 251/5 |

*Primary Examiner*—Philip R. Coe

*Attorney, Agent, or Firm*—Bell, Seltzer, Park & Gibson, P.A.

[57] ABSTRACT

Tubes (12), which can have any variety of cross-section and multiple bends, to be cleaned each have one end portion retained within a fixture (16) by an expanded bladder (42) while pressurized cleaning fluid (52) from conduit (50) passes through the tubes (12). Where no tube (12) is positioned within a particular fixture (16), the cleaning fluid (52) is prevented from moving through the fixture by the expanded bladder (42).

12 Claims, 4 Drawing Sheets

TUBE CLEANING APPARATUS

BACKGROUND

1. Field of the Invention

The present invention relates generally to apparatus especially effective for cleaning the inside surface of relatively long, multi-bend tubing or tubes such as are utilized in aircraft hydraulic lines and missile structures, for example.

2. Description of Related Art

The cleaning of the interior of tubes, especially relatively small diameter tubes and those which include throughout their length a number of bent or curved portions, is an especially difficult one, primarily as the result of the difficulty of inserting conventional tools or other cleaning apparatus into the tube and moving it along the full tube length. A most common technique for cleaning metal parts including the interior of tubes has been the use of so-called degreasing or vapor degreasing agents in which the parts are immersed in or exposed to a quantity of the cleaning liquid or vapor. This approach has been adopted extensively in the metal finishing industry. As a result of the known adverse impact upon the environment, the use of such vapor degreasing agents is being phased out totally along with other materials including chlorofluorocarbons (CFCs).

Depending upon the ultimate use for the tubes, the cleanliness of the surface required can vary considerably. In the case of gaseous oxygen or hydraulic lines used in aircraft or liquid oxygen carrying lines in missile usage, for example, the requirement is that they be kept extremely clean and this, of course, requires a more intensive cleaning operation. In the past, even when known highly efficient vapor degreasing agents were used, many hydraulic line tubing configurations had to be individually flushed with a solvent liquid in order to achieve the required high degree of cleanliness. As might be predicted, this resulted in a labor intensive and relatively expensive cleaning operation.

Cleaning of tubes or tubing is also exacerbated by the fact that, in practice, the cross-sectional geometry of the tubes can vary considerably (e.g., circular, oval, square or rectangular) as well in their dimensions. This means that if the cleaning is to be accomplished by flushing the tube interior with a liquid, that the tube must be secured in a fixed manner and, of course, unless the apparatus is configured for but a single use, the securement means would have to be capable of being adapted to the tubing geometry and dimensions.

Since the more efficient vapor degreasing materials are being phased out of use, it will now become necessary to utilize other materials which in order to achieve a practical industrial process may require both increasing pressure as well as enlarging the cleaning time per unit of tube which will require corresponding modifications in apparatus for retaining the tube in position while applying the cleaning agent to the tube surfaces desired to be cleaned.

SUMMARY OF THE INVENTION

In the practice of the present invention there are provided a plurality of tube retaining fixtures which are unitarily mounted onto a common manifold housing. Each of the fixtures includes an internally located expandable bladder. The bladders of all of the manifold fixtures are interconnected via a suitable valving means with a source of a hydraulic or pneumatic fluid enabling selective expansion or contraction of the bladders. The manifold housing may be mounted to an inner wall surface of a wire mesh holding basket such that the basket and manifold with retaining fixtures can be moved as a unit during a cleaning operation.

In use, one, two or all of the retaining fixtures can be loaded with the same or different cross-section tubes or tubing to be cleaned, the individual tubes being slid into the fixtures while the expandable bladders are in relaxed condition. With either a pressurized liquid or pressurized gas being provided to all of the different bladders, the bladders then expand inwardly toward the central axis of each fixture and holding a tube or tubing to be cleaned firmly in place with the holding means intimately contacting the external surface of the tube or tubing. For those retaining fixtures that do not include a tube or tubing to be cleaned, the bladder merely expands until it contacts itself and closes off the entire passage through that particular retaining fixture. Next, the basket and manifold housing with tubes to be cleaned are then placed as a unit into an open-topped reservoir of cleaning fluid. Finally, by a suitable pressurizing means cleaning fluid is forced through the various tubes held within the manifold fixtures to effect internal cleaning, after which the cleaning fluid exits into the reservoir. The external tube surfaces are simultaneously cleaned by being immersed into the reservoir cleaning fluid, or alternatively may be spray cleaned if not immersed.

BRIEF DESCRIPTION OF THE DRAWING

The advantages and features of the disclosed invention will be readily appreciated by persons skilled in the art from the following detailed description when read in conjunction with the drawing wherein.

DESCRIPTION OF A PREFERRED EMBODIMENT

Figure 1:
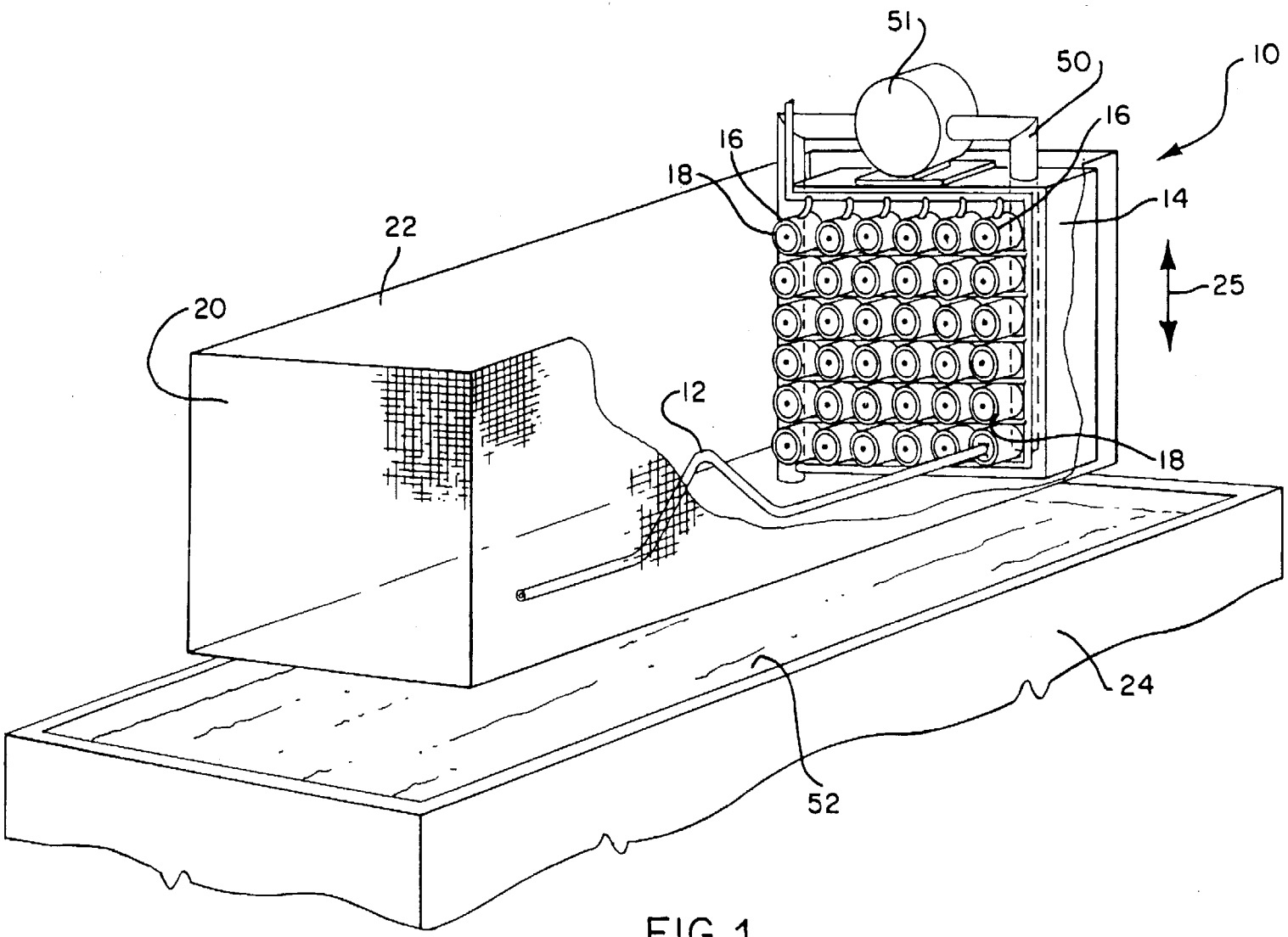
FIG. 1 is a perspective, partially fragmentary view of the tube cleaning apparatus of the invention.

In the following detailed description and in the several figures of the drawing, like elements are identified with like reference numerals.

Turning now to the drawing and particularly FIG. 1, the tube cleaning apparatus of the invention is enumerated generally as 10 which, in a manner that will be described, is especially advantageously employed for cleaning the interior surfaces of one or many tubes or tubings 12 simultaneously, only one of which is shown. The apparatus includes a generally rectangular manifold housing 14 within which are mounted in generally parallel arrangement, a plurality of retaining fixtures 16 presenting open ends 18 for respectively receiving and holding, in a way that will be more particularly described later, tubes 12 to be cleaned.

In its major constructional aspects, the manifold housing 14 is mounted within a wire mesh holding basket 20 having an open top 22. The basket with manifold housing and included retaining fixtures is mounted for movement along a path into and out of an open-top reservoir 24 as shown by the arrow 25.

Figure 2:
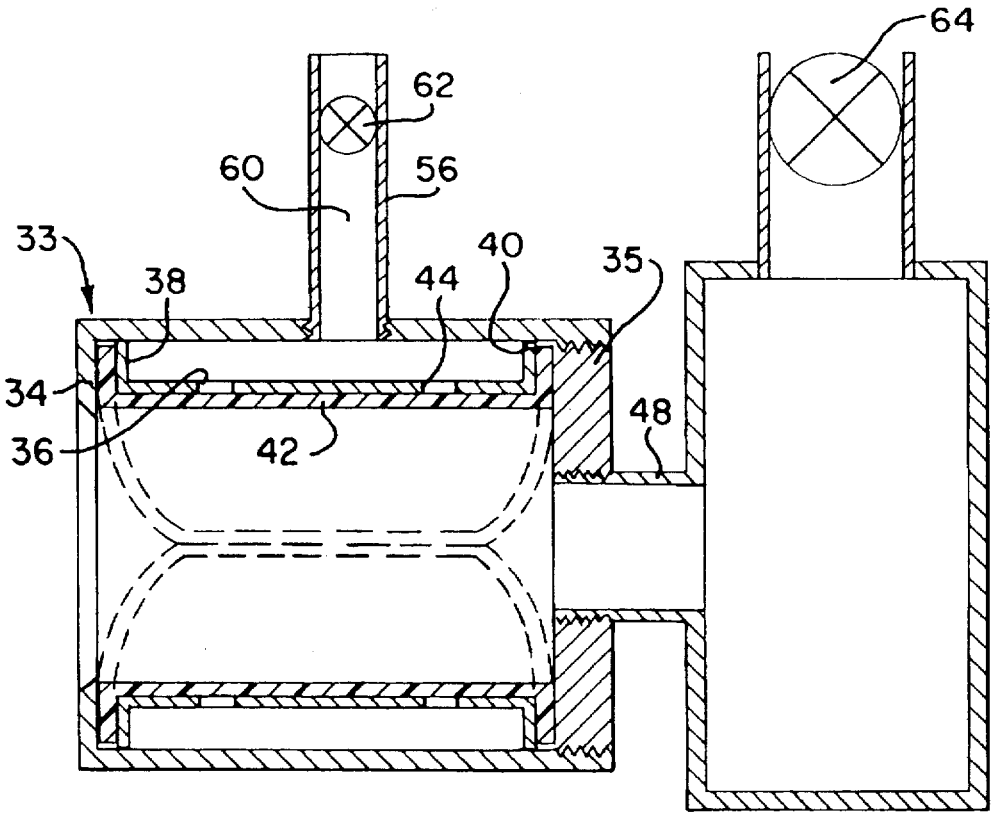
FIG. 2 is a side elevational, sectional view of one form of tube retaining fixture of the invention shown prior to retaining use.
Figure 3:
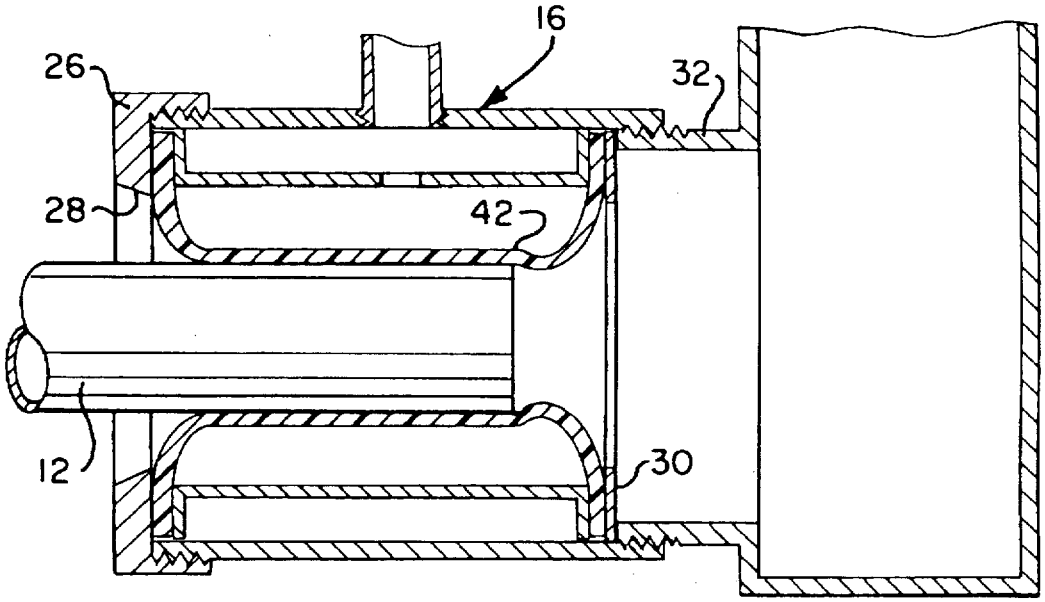
FIG. 3 is a side elevational, sectional view of a retaining fixture similar to FIG. 2 showing a tube to be cleaned secured therein.

With reference now to FIG. 3, each fixture 16 is seen to include a removable end cap 26 that is threaded onto the outer tube receiving end of the fixture and which has an opening 28 generally aligned with the fixture longitudinal axis. The opposite end of each fixture is secured by a washer 30 held in place by a conduit 32 threaded into the fixture end. An alternative fixture construction 33 is shown in FIG. 2 and seen to include the generally cylindrical shape of fixture 16 having a radially inwardly directed flange 34 at the outer end (i.e., tube 12 entrance end) and a threaded washer 35 received in the opposite end.

A cylindrical metal spool 36 with integral circular end flanges 38 and 40 is located within either fixture 16 or 33 and is so dimensioned that when the end cap 26 is tightened onto the fixture end (or washer 35 threaded in place), the spool flanges 38 and 40 will clampingly secure edge portions of a flexible cylindrical bladder 42 in an air-sealed manner. The bladder 42 is constructed of a material such as butyl rubber that enables expansion from a relaxed position as shown (solid line) in FIG. 2 to the expanded or retaining position depicted in dashed lines. The cylindrical spool 36 includes a plurality of openings 44 for passing a pressurized fluid, either gas or liquid, to control the inflation or retraction of the bladder walls 42, as desired.

Figure 4:
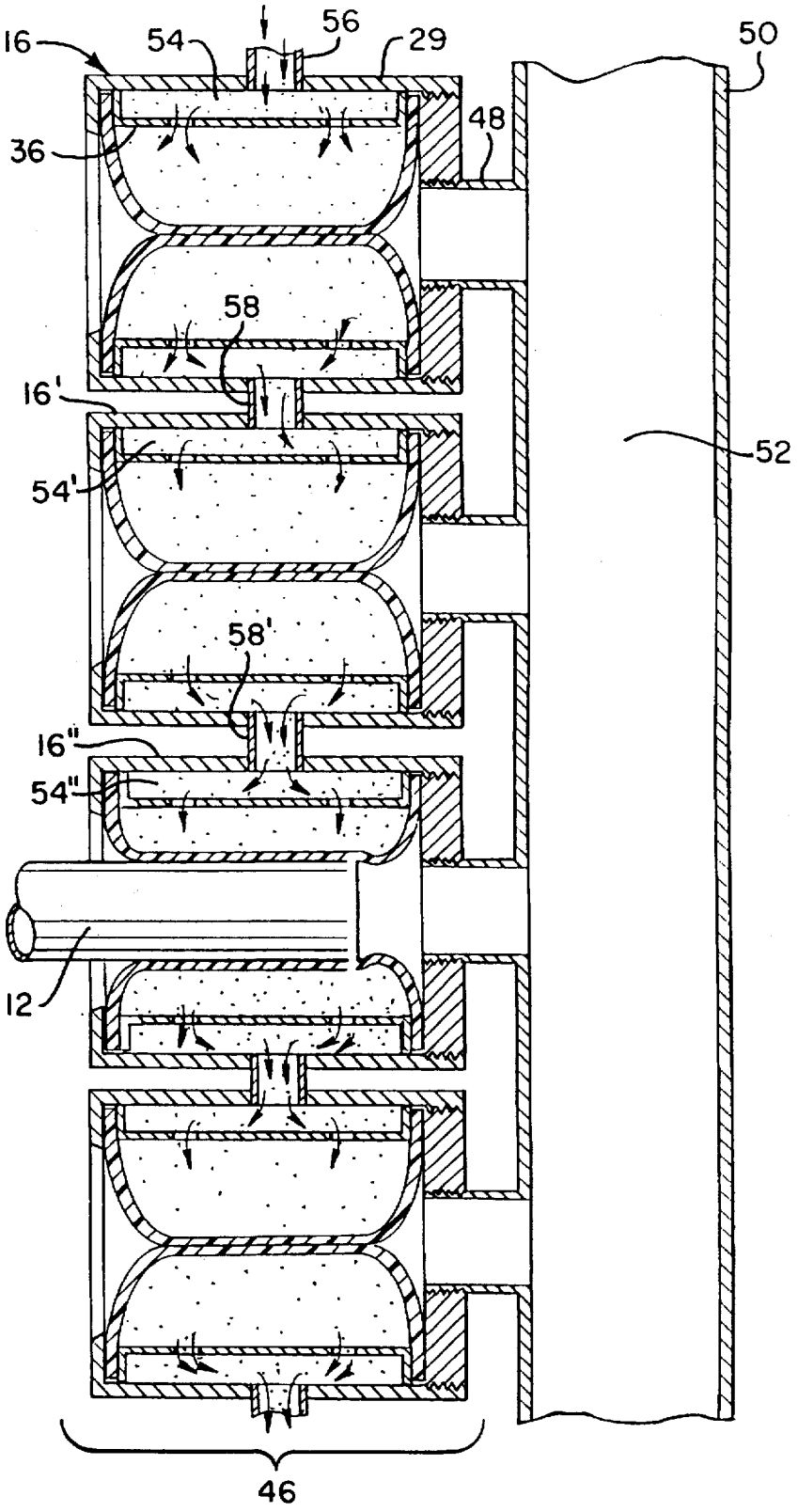
FIG. 4 is a side elevational, sectional view of several columnarly arranged retaining fixtures of the invention shown being simultaneously provided with bladder expanding fluid.

FIG. 4 shows the detailed interconnections of the different fixtures 16 arranged in a column 46 within the manifold housing 14. More particularly, the cylindrical wall 29, for example, of each fixture 16, 16', 16" - - - is threaded onto the outer end of a pipe fitting 48, the latter communicating with the interior of a conduit 50 mounted within housing 14 and supplied with pressurized cleaning liquid 52. However, the uppermost tube retaining fixture 16 has an internal space 54 defined by the fixture internal wall, flanges 38 and 40, and the cylindrical spool 36 for being filled with a pressurized bladder inflating fluid (not shown) via fitting 56. A tubular member 58 interconnects the pressurized bladder inflating fluid within space 54 with the corresponding space 54' in pipe 16'. In similar fashion, a tubular member 58' interconnects the space 54' with space 54", and so forth so that the fixtures 16, 16'—of the column are all interconnected with the supply lines 49 and 50 of the bladder inflating fluid (FIG. 1). Still further, the fixtures 16 in columns other than column 46 are all mounted within housing 14 and connected to receive cleaning fluid from supply line 50 in the same manner as just described for the fixtures in column 46.

In use of the described apparatus and assuming each retaining fixture 16 is in the relaxed mode (solid line FIG. 2), those tubes 12 which it is desired to clean have their end portions positioned within respectively individual fixtures 16 and the opposite basket 20. Next valve 62 is actuated to the "on" condition adding pressurized fluid to the fixture interiors inflating all of the bladder walls 42. Accordingly, all tubes 12 to be cleaned are securely held by expanded bladder walls 42 (FIG. 3) and those fixtures 16 which do not include a tube 12 have their interiors blocked off by the expanded bladder walls against liquid flow therethrough as shown in phantom line, FIG. 2. Now, the basket with the retained tubes is preferably although not necessarily lowered within the reservoir 24 (FIG. 1). Finally, valve 64 is set to the "on" mode causing pressurized cleaning liquid 52 to enter conduit 50 and pass through tubes 12 to clean the interior surfaces of the tubes after which the liquid exits into the reservoir. Where there is no tube 12 retained in a fixture 16 (FIG. 2) the bladder wall 42 closes off the fixture opening against the passage of cleaning liquid as shown by the phantom lines.

An alternative cleaning fluid provision and control means includes a pump 51 (FIG. 1) which pressurizes the cleaning fluid in conduit 50 when actuated for use and does not require the valve 64.

Figure 5:
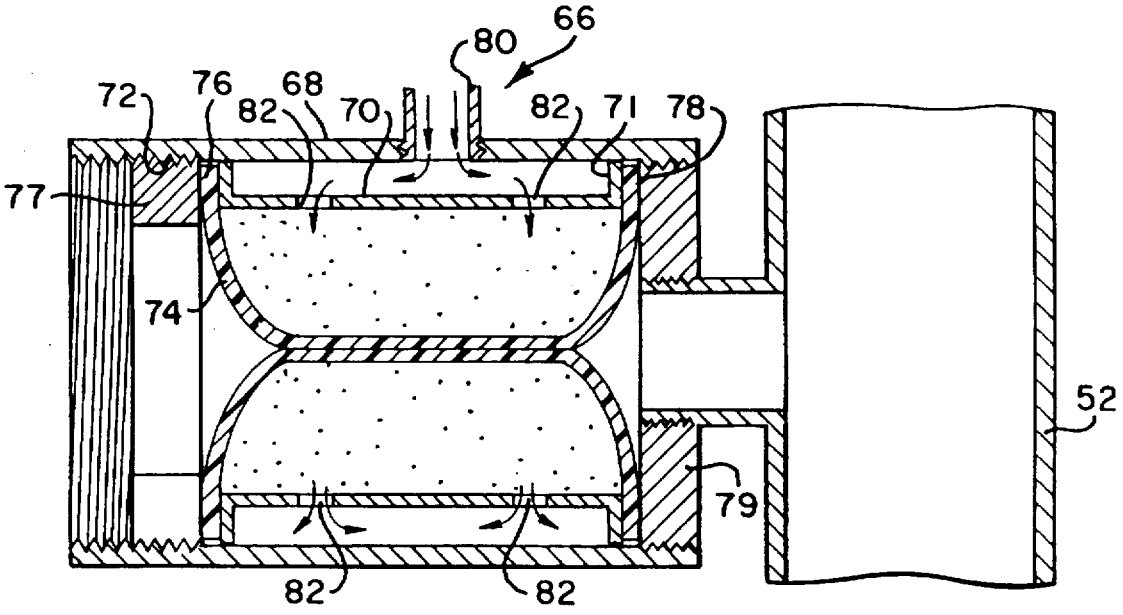
FIG. 5 depicts an alternative version of retaining fixture.

A further alternative embodiment fixture 66 shown in FIG. 5 includes a hollow open-ended metal cylindrical housing 68 and a cylindrical spool 70 having a plurality of spaced apart outwardly extending circular flanges 71 on the spool external peripheral surface. The dimensions of the spool are such that it can be slidingly positioned within the housing 68 and does not obstruct internal threads 72 located on the internal walls of both housing end portions. A bladder means 74, which can be constructed of the same material as the bladder 42, is generally cylindrical with radially outwardly extending flange portions 76 and 78 at its respective ends and of such dimensions as to fit about respective ends and of such dimensions as to fit about the spool with the flange portions extending over the spool outer end edges. First and second threaded washers 77 and 79, respectively, when threaded into the two housing ends clamp against the bladder means flanges sealing them against the spool ends. In use, the inflating fluid on entering fitting 80 passes through opening 82 in the spool to expand the bladder means in the same manner as in the first-described embodiment. Similarly, release of the inflating fluid pressure will cause the fluid to pass out through the fitting 80 placing the bladder means in a relaxed or non-retaining condition.

Although we are primarily concerned here with the cleaning of tube or tubes interior surface, it is important to note that by merely immersing the tube or tubing into the reservoir cleaning liquid the outer surface areas experience a substantial cleaning effect.

Although the invention is described in connection with mounting the housing 14 and included apparatus within an open container or basket 20, it is contemplated that housing 14 included apparatus and tubes 12 may be located within a cabinet and then simultaneously cleaning the interior of the tubes by a pressurized fluid in the manner described as well as spraying cleaning fluid onto tubes exterior for cleaning the same.

The invention has been described in connection with a preferred embodiment, however, it is to be understood that those skilled in the appertaining art may contemplate modifications that come within the spirit of the invention as described and within the ambit of the claims that follow.

What is claimed is:

1. An apparatus for releasably retaining a hollow tube having a proximal tube end and a distal tube end, the apparatus being adapted for retaining the hollow tube while passing a cleaning fluid through the hollow tube from the proximal tube end to the distal tube end, the apparatus comprising:

a hollow open-ended fixture having a side wall with an internal surface forming a passageway;

an expandable generally cylindrical bladder having edge portions hermetically sealed to the internal surface of the fixture;

means mounted onto the fixture for selectively directing a pressurized fluid through said fixture in a first direction to expand the bladder away from the internal surface of the fixture sufficiently to bring certain tube engaging surfaces on said bladder into contact with each other when otherwise unrestrained; and a conduit interconnected with an open end of the fixture for directing cleaning fluid into the fixture passageway and through the hollow tube from the proximal tube end to the distal tube end.

2. The apparatus as recited in claim 1, in which the fixture includes a radially inwardly directed integral flange adjacent to one open end of said fixture and a threaded washer releasably received within the other open end of said fixture, said flange and threaded washer clampingly securing the bladder within the fixture.

3. The apparatus as recited in claim 2, in which a cylindrical spool with radially outwardly extending end flanges is received within the fixture, and the bladder edge portions are clamped against the spool flanges by the fixture flange and the threaded washer.

4. The apparatus as recited in claim 1, in which the bladder is constructed of butyl rubber.

5. The apparatus as recited in claim 1, in which the bladder is constructed of a synthetic elastomer.

6. An apparatus for releasably retaining a hollow tube having an inner surface and an outer surface, the apparatus being adapted for retaining the hollow tube while passing a cleaning fluid through the hollow tube and over the inner surface of the hollow tube, comprising:

a hollow open-ended fixture having a fixture internal wall which is adapted for receiving the hollow tube therein;

an expandable generally cylindrical bladder operatively connected to the fixture internal wall, the bladder being adapted for being inflated, to thereby seal the outer surface of the hollow tube to the fixture internal wall;

a first fluid source adapted for inflating and deflating the bladder; and a second fluid source interconnected with an open end of the fixture for directing cleaning fluid through the hollow tube and over the inner surface of the hollow tube.

7. The apparatus as recited in claim 6, the second fluid source directing fluid through the hollow tube and over the inner surface of the hollow tube, and the bladder preventing fluid from passing over the outer surface of the hollow tube.

8. An apparatus for releasably retaining a hollow tube while passing a cleaning fluid through the hollow tube, comprising:

a hollow open-ended fixture having a side wall with an internal surface forming a passageway;

an expandable generally cylindrical bladder having edge portions connected to the internal surface of the fixture;

a first conduit mounted onto the fixture for selectively directing a pressurized fluid into the bladder to expand the bladder away from the internal surface of the fixture; and a second conduit interconnected with an open end of the fixture for directing cleaning fluid into the fixture passageway and through the hollow tube.

9. The apparatus as recited in claim 8, the bladder being adapted for creating a seal between the internal surface of the fixture and an external surface of the hollow tube.

10. The apparatus as recited in claim 9, the bladder being adapted for creating the seal at a proximal end of the hollow tube, located at the open end of the fixture.

11. The apparatus as recited in claim 10, the hollow tube comprising an internal surface, and the bladder being adapted for preventing flow of fluid from the second conduit over the external surface of the hollow tube.

12. An apparatus for releasably and simultaneously retaining a plurality of hollow tubes while passing a cleaning fluid through the plurality of hollow tubes, comprising:

a plurality of connected hollow open-ended fixtures, each fixture having a side wall with an internal surface forming a passageway;

a plurality of expandable, generally cylindrical bladders, each bladder having edge portions connected to an internal surface of a corresponding fixture;

a plurality of first conduits mounted onto the fixtures for selectively directing pressurized fluid through said fixtures to thereby expand the bladders away from the internal surfaces of the fixtures; and a plurality of second conduits interconnected with open ends of the fixtures for directing cleaning fluid into the fixture passageways and through the plurality of hollow tubes.

* * * * *